United States Patent [19]

Nagel

[11] 4,220,832

[45] Sep. 2, 1980

[54] TWO-WAY SPEAKER WITH TRANSFORMER-COUPLED SPLIT COIL

[75] Inventor: Martin J. Nagel, Russell Township, Geauga County, Ohio

[73] Assignee: Tenna Corporation, Cleveland, Ohio

[21] Appl. No.: 10,502

[22] Filed: Feb. 8, 1979

Related U.S. Application Data

[63] Continuation-in-part of Ser. No. 924,638, Jul. 14, 1978, which is a continuation-in-part of Ser. No. 746,796, Dec. 2, 1976, Pat. No. 4,130,725.

[51] Int. Cl.[2] ..... H04R 1/26; H01F 5/00

[52] U.S. Cl. ..... 179/115.5 PS; 179/115.5 DV

[58] Field of Search ..... 179/115.5 PS, 115.5 DV, 179/115.5 VC, 1 A

[56] References Cited

U.S. PATENT DOCUMENTS

| | | | |
|---|---|---|---|
| 2,007,748 | 7/1935 | Olson | 179/115.5 DV |
| 2,164,374 | 7/1939 | Barker | 179/115.5 DV |
| 2,205,365 | 6/1940 | Schwaen | 179/115.5 DV |
| 2,925,541 | 2/1960 | Koch | 179/115.5 VC |
| 2,959,640 | 11/1960 | Schultz | 179/1 A |
| 3,196,211 | 7/1965 | Kessenich | 179/115.5 DV |
| 3,686,446 | 8/1972 | Manger | 179/115.5 DV |

FOREIGN PATENT DOCUMENTS

| | | | |
|---|---|---|---|
| 1047843 | 12/1958 | Fed. Rep. of Germany | 179/115.5 DV |
| 553225 | 12/1956 | Italy | 179/115.5 DV |
| 665815 | 1/1952 | United Kingdom | 179/115.5 PS |

*Primary Examiner*—Daryl W. Cook

*Attorney, Agent, or Firm*—Watts, Hoffmann, Fisher & Heinke Co.

[57] ABSTRACT

A loudspeaker with an overlay or bifilar wound split voice coil, a coil for driving a higher frequency speaker such as a tweeter, and a push-pull audio amplifier circuit directly coupled with the coils. The configuration of the split coil provides two coaxial voice coils that produce a transformer coupling at high frequencies. This coupling compensates for the normally experienced increased input impedance at high frequencies and results in a fairly constant input impedance over a large frequency range, facilitating uniform power transfer to the speaker. The high frequency voice coil is coupled across the split coaxial coils and is energized at high frequencies by a combined signal which includes the signal directly applied to one of the coaxial coils and the induced signal in the other coaxial coil.

9 Claims, 5 Drawing Figures

TWO-WAY SPEAKER WITH TRANSFORMER-COUPLED SPLIT COIL

CROSS REFERENCE TO RELATED APPLICATION

This application is a continuation-in-part of application Ser. No. 924,638 filed July 14, 1978 entitled "Overlay-Coil Speaker with Direct Coupling," which is a continuation-in-part of application Ser. No. 746,796, filed Dec. 2, 1976, U.S. Pat. No. 4,130,725, entitled "Split Coil Speaker with Direct Coupling."

BACKGROUND OF THE INVENTION

1. Field of the Invention

This invention relates to an improved two-way speaker arrangement. One voice coil in the arrangement is a split, overlay or bifilar wound coil that achieves effective transformer coupling between the two coil halves and the other voice coil is a less massive high-frequency coil coupled across the split coil.

2. Prior Art

A typical speaker arrangement includes a cone or vibrating structure which when vibrating with the frequency of the sound to be produced causes the speaker to emit that sound. In an audio system, the sound to be produced is generated by an electrical signal typically of voltage proportional to desired output level with frequency variations equal to the frequency variations of the sound. It is the function of the speaker to convert this electrical signal into mechanical vibrations and, hence, sound.

One technique for this conversion involves the sending of an electrical signal representation of the sound to be produced through a voice coil placed in a magnetic field. It is well known that when an electric charge moves in a magnetic field a force is exerted upon that charge. By applying an electrical signal, such as the amplified signal produced from a sound recording or radio receiver, to a coil of wire within a magnetic field, the coil can be moved at a frequency corresponding to the frequency variations in the applied electrical signal. Coil movement is transformed to sound through a cone or other vibrating structure of the speaker. One problem in speaker design is to achieve the conversion of electrical energy to sound in an efficient manner.

Applicant's copending application Ser. No. 924,638 discloses a split, overlay or bifilar wound, voice coil directly coupled to a push-pull type circuit to achieve efficient conversion. This device is a so called one-way speaker, because a fairly broad frequency range of driving signals are converted in one voice coil. The overlay or bifilar design and split coil driving circuit of that device produce a more efficient energy conversion due to a transformer coupling effect between the two halves of the split coil at high frequencies.

The one-way speaker must be constructed from one size voice coil, which results in non-uniformity in voice coil response with driving frequency. Due to this fact, two-way speakers have been constructed in which one coil converts energy in the low frequency range and a less massive coil is driven in the high-frequency range. Typically, a so-called woofer converts the low-frequency signal and a so-called tweeter converts the high-frequency signal. In both the tweeter and woofer present state of the art two-way coil systems typically are provided with driving signals whose voltage is proportional to the desired output level. When the driving frequency varies in these state-of-the-art two-way coils, however, the effective power to those coils varies a great deal due to inductive loading of the coil and a non-uniform coil response is produced over the audio frequency range.

SUMMARY OF THE INVENTION

The present invention provides a speaker of high fidelity output with an improved two-way speaker arrangement for increasing the efficiency with which the speaker is driven, over a broad frequency range. The speaker includes a first cone and a magnet assembly defining a gap across which a magnet flux extends to form a magnetic field. A split wire coil is secured to this first cone and is movable axially in the gap. The split coil is in the form of two coils with a common center tap, each wound in a helix. The two coils are either bifilar wound or the second coil is wound co-axially with and over, i.e., about or around, the first coil, to achieve effective transformer coupling between the two coils. Mechanical biasing means maintain the coils at a location within the extent of the useful magnetic field. It is intended that only one of the coils will be directly energized at a time. As the frequency of the driving signal increases, the coil arrangement creates a transformer coupling affect that decreases load impedance and partly compensates for the typical increase in impedance at increased frequencies due to the inductive affect.

A second cone and magnetic assembly define a second gap for a third energized coil. This arrangement creates a two-way speaker with one frequency range efficiently reproduced by the coaxially wound coils of the split coil and a second range effectively reproduced by the third voice coil. The invention also provides, in combination with such a two-way speaker, a directly coupled push-pull amplifier circuit for driving all three coils.

One or the other of the two coaxial coils forming the split coil is alternately energized by the signal from the amplifier circuit. With one coil arranged about the other, the changing magnetic field produced by the coil that is energized induces a current within the non-energized coil. The resulting current in the two coils is acted upon by the magnetic field of the speaker magnet, which causes the speaker coils to move. The separately and alternately energized voice coils result in particularly efficient energy conversion at the high frequency range of speaker operation. The normally high increases in the coil impedance with higher frequencies are partly offset by compensating decreases in impedance due to the transformer coupling between the two coils. At higher frequencies the coils act as two impedances connected in parallel rather than in series, and effectively halve the input impedance that the amplifier would otherwise be required to drive.

The overlay or bifilar would coil configuration has a further advantage. It is known within the art that the efficiency of a speaker is dependent upon the copper volume of the voice coil within the magnetic field. By winding one coil about the other, the effective volume of conductive material within the magnetic field is doubled at high frequencies due to the transformer coupling.

The split coil is driven by a directly coupled, high-fidelity, push-pull amplifier circuit without signal or stabilizing feedback circuitry. Two transistor current amplifiers are coupled each to a different half of the split speaker coil as followers without voltage gain, the gain of the circuit coming rather from the turns ratio of a transformer and being essentially independent of the transistor parameters. Good performance is achieved with few components, keeping costs relatively low.

In accordance with this invention, the third voice coil is connected across opposite ends of the split coil to provide high frequency response when the transformer coupling effect is occurring within the two coaxial coils. Although transformer coupling of the two coaxial coils enhances efficiency at high frequencies, their relatively large mass needed to respond to low frequency signals is disadvantageous for the high frequencies. The third coil is chosen of relatively low mass to provide better high frequency performance. Since the third coil is connected across the two coaxial coils of the split coil, it responds to not only the driving signal from the amplifier, but to the induced signal in the non-energized coaxial coil. In this manner the voltage appearing across the third voice coil is double the voltage which would appear if that coil were conventionally coupled to the amplifier circuit.

Since it is desirable to block out low frequency signals to the third coil, a suitable capacitor is connected in series with the third coil to allow only high frequency signals to pass to the third coil. In this way, the split coil responds to driving signals at low frequencies and the combined coaxial coils of the split coil, in conjunction with the third coil, respond at high frequencies. This arrangement produces more uniform power transfer over a broad frequency spectrum.

The present invention finds particular use as a high power speaker and amplifier combination when connected to the output of a relatively low-power amplifier and energized through an external, low-voltage, single-ended, power source to increase the amplifier output. It is particularly useful with car radios, tape players, citizens band receivers and similar sound products, which operate from low-voltage, single-ended, power supplies, such as automotive batteries, and serves to greatly increase the volume while maintaining superior frequency response.

DESCRIPTION OF A PREFERRED EMBODIMENT

Figure 1:
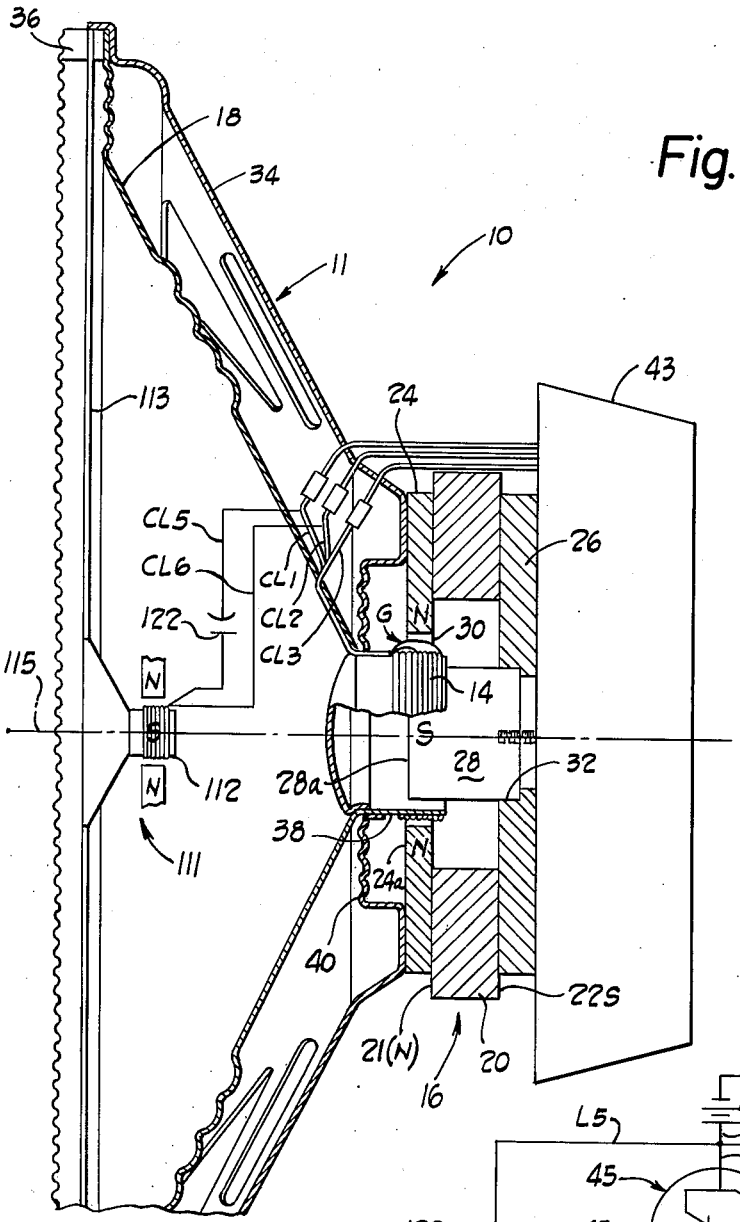
FIG. 1 is a sectional view, with parts in elevation, illustrating a loudspeaker system with one speaker including split overlay voice coil, and a separate second speaker with a lightweight voice coil electrically coupled to the split coil.
Figure 2:
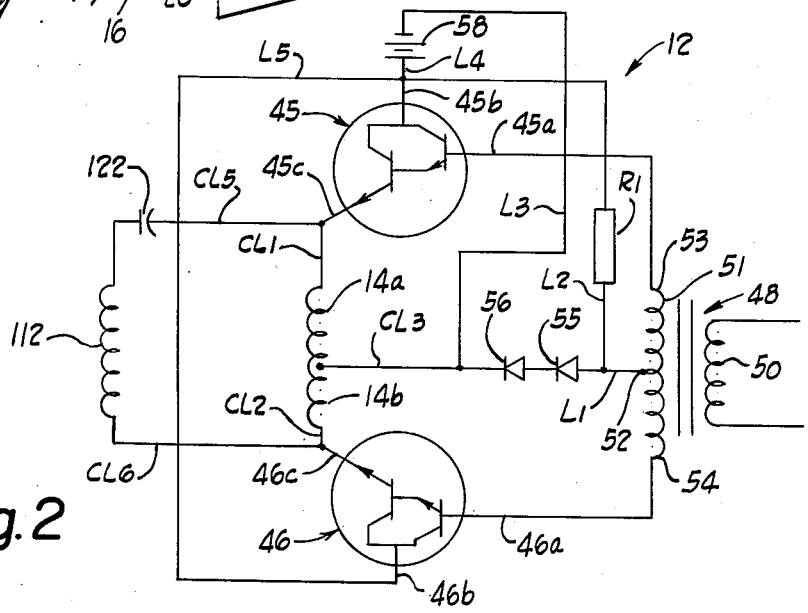
FIG. 2 is a schematic drawing of a preferred circuit for energizing the voice coils of the speaker system shown in FIG. 1.

The present invention is embodied in an improved speaker system 10 shown in FIGS. 1 and 3 of the drawings, and in the improved speaker system 10 and a directly coupled amplifier circuit 12, shown in FIG. 2, in which power amplification is obtained from power supplied from an external source.

The speaker system 10 utilizes a first loudspeaker 11 with a split driving coil 14 moveable relative to a permanent magnet assembly 16, to drive a cone 18. The driving coil is of bifilar or overlay configuration, which results in uniform coil movement over a wide range of audio frequencies due to transformer coupling between two portions of the split coil 14. A second loudspeaker 111 is electrically connected to the first loudspeaker and includes a conventional lightweight voice coil 112.

The permanent magnet assembly 16 is comprised of a magnetic annulus 20 with north and south pole faces 21, 22, respectively, soft iron front and back end plates 24, 26, and an iron core 28, which provide a magnetic circuit path. Both plates 24, 26 are annular. One end 28*a* of the core 28 is essentially flush with the front surface 24*a* of the front end plate 24. The opposite end of the core 28 is received with an interference fit in a central aperture 32 of the end plate 26. This construction provides an annular gap G, with a depth equal to the thickness of the plate 24 and in which the coil 14 is located. The plate 24 forms a north magnetic pole about the outer periphery of the gap G and the core 28 forms a south magnetic pole, with the magnetic flux passing across the gap G along the entire length or depth.

The first speaker 11 has a conventional rigid frame 34, for example, of sheet metal. The wide end or front of the cone 18 is secured at the front of the frame 34 and the permanent magnet assembly 16 is secured to the back of the frame 34. A mounting gasket 36 is secured to the cone at the front of the frame. A cylindrical coil form 38 is attached to the apex of the cone 18 and extends rearwardly into the permanent magnet assembly 16. A spider 40 is attached between the coil form 38 and the frame 34, locating the coil form within the annular gap G of the permanent magnet assembly and serving as a spring return, to urge the coil form in a direction along the axis of the form, back to the neutral position shown in FIGS. 1 and 3A, after an excursion. The second speaker 111 is mounted to the first speaker frame 34 by means of a bracket 113. The second speaker has an axis 115 coincident with an axis defined by the center of the first speaker cone 18.

Figure 3A:
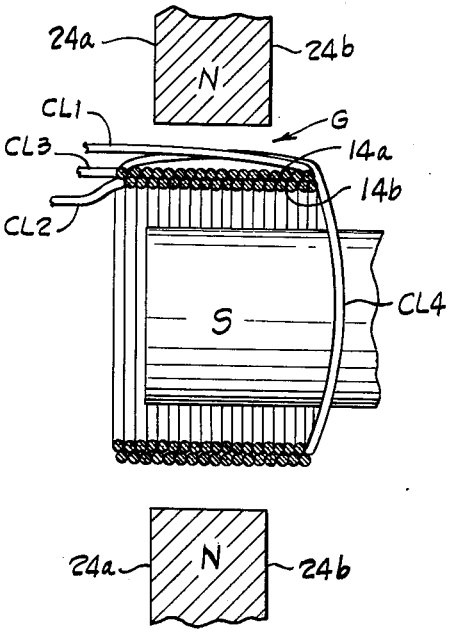
FIGS. 3A and 3B are enlarged sectional views of the split speaker coil and associated speaker magnet of FIG. 1, diagrammatically illustrating the relationship between the split speaker coil and the magnet when the split coil is unenergized (FIG. 3A) and when one coil of the split coil is energized (FIG. 3B).
Figure 3B:
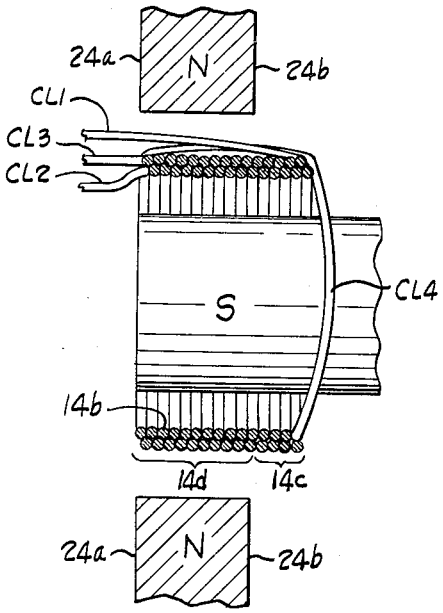

As best shown in FIG. 3A, the coil 14 of the speaker 11 includes two equal length layers or coils 14*a*, 14*b* would in the same direction to form a concentric helical arrangement. Their length is greater than the thickness of the plate 24, which defines the depth of the gap G. When neither coil 14*a*, 14*b* is energized, both are located by the spider 40 within the gap so they extend equally beyond opposite sides of the plate 24. One end of the coil 14*a* and the opposite end of the coil 14*b* are connected to an energization circuit by a pair of electrical connections CL1, CL2. When energized the coils move due to the electro-magnetic forces exerted on the coils by the magnetic field in the gap. The excursion of the coils during this movement brings one end of the split coil closer to the gap and moves the other end of the split coil away from the gap. The length of the split coil, however, is such that at maximum excursion the end moving toward the gap essentially does not actually enter the gap. This design insures that the length of current carrying wire in the gap remains essentially constant. The unenergized ends of the coils 14*a*, 14*b* are electrically joined by a connector CL4. This point of electrical connection between the two wires is connected to ground by means of a connector CL3 as shown in both FIG. 3A and FIG. 2.

While the coils 14*a*, 14*b* have been shown in an embodiment where the length of the coils is greater than the gap G, the length of these coils 14*a*, 14*b* could be less than the gap length. In this alternate configuration the magnet endplate 24 would be wider than that shown while the length of the coils 14*a*, 14*b* would be shorter. In this configuration the movement of the shortened coils is of such an extent that the coils essentially never emerge from the gap. At maximum excursion the coil ends approach the edge of endplate 24 essentially without passing it and therefore the coils at all times remain within the gap. This alternate arrangement as well as the embodiment described earlier therefore insures that the amount of magnetic flux interupted by current carrying wire is essentially constant regardless of coil movement.

When the wire turns of either coil 14*a*, 14*b* are energized by the energization or amplifier circuit, the resultant force on the wire turns will tend to move the coils 14*a*, 14*b* within the gap G, thereby moving the cone 18. The direction in which the turns are wound is such that energization of coil 4*a* moves the combined coil 14 in one direction and energization of coil 14*b* moves it in the opposite direction. Thus, with reference to FIGS. 3A and 3B, when coil 14*b* is energized, the coil 14 moves from its equilibrium position shown in FIG. 3A to the position shown in FIG. 3B in which one end of the combined coil 14 is adjacent the front surface 24*a* of the endplate 24. At maximum excursion, a portion 14*c* of the coil 14 will be beyond the gap G and a second portion 14*d* will be totally within the gap G so that only a portion of the current is being significantly driven by the magnet.

The bifilar or overlay configuration of the coils 14*a*, 14*b* results in transformer coupling between the two. When one coil 14*a*, or 14*b* is energized, the electric current in that coil is not only affected by the permanent magnet plate 24, but also creates its own changing magnetic field. During the time period in which the current in the energized coil is increasing it induces a magnetic field which in turn induces a current in the non-energized coil.

The transformer coupling between the two coils 14*a*, 14*b* tends to reduce the input impedance at high frequencies. At low frequencies the current in the energized coil is not varying rapidly enough to produce significant magnetic induction effects. At the high frequencies, however, the transformer coupling produces an effect whereby the two coils 14*a*, 14*b* act as two impedances in parallel with a consequent halving of their input impedance.

Figure 4:
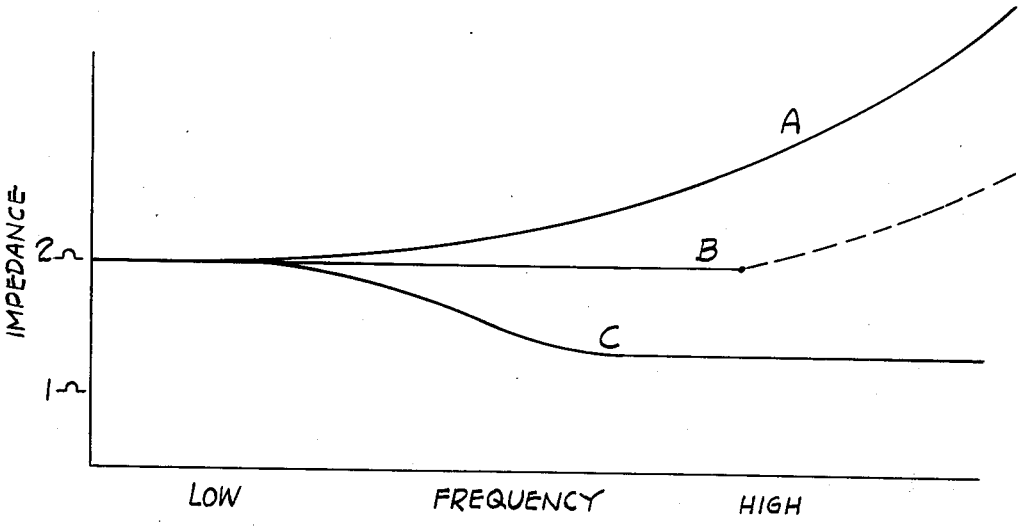
FIG. 4 is a graphical representation of the improved impedance characteristics of the split coil.

The resultant beneficial consequences of this overlay coil arrangement can qualitatively be understood with reference to the graph of FIG. 4, which illustratively represents a plot of effective input impedance of the combined coil 14 as it varies with driving frequency. At low frequencies the input impedance of the coil 14 is a relatively constant 2 ohms. (The low frequency impedance of any particular coil may vary from 2 ohms and that value is used by way of example only, to illustrate the typical performance of a coil embodying the present invention). As the frequency increases, three curves, A, B, and C are shown.

Curve A represents a self inductive increase in the input impedance of a single coil without any coupling effect (e.g., nonoverlay construction). Without an overlay arrangement or the like that produces a coupling effect, this increase in coil impedance retards power transfer at high frequencies, with an accompanying poor quality sound reproduction.

Curve C represents the input impedance of a bifilar or overlay coil arrangement with transformer coupling and high frequency and inductive effects ignored. At high frequencies the transformer effect of the two coils tends to decrease the impedance, until it approaches one half its original value. In the particular example illustrated, the reduction in impedance reduces the impedance to one ohm.

Where transformer coupling is achieved with a bifilar or overlay coil construction, the two effects depicted by the graph combine to produce an average value of input impedance approximately represented by curve B. At high frequencies the impedance begins to rise but these frequencies are outside the audio range and consequently do not adversely affect speaker performance. The coupling resulting from the coil configuration therefore results in substantially uniform input impedance of each coil and a more uniform power transfer from the amplifier circuit to the speaker cone 14 over a broad range of audio frequencies.

The coil configuration produces an additional advantageous effect due to the doubling of conductive material within the magnetic gap G. At high frequencies the inductive transformer coupling produces two current flows in the coils 14*a*, 14*b* and the effective volume of coil within the gap is twice the volume for a single layer coil. It is known within the art that the efficiency of power transfer is proportional to the volume of the speaker coil. By doubling the effective coil volume while yet energizing only one of the coils 14*a*, 14*b* at a time, an increase in efficiency in addition to the decreased input impedance due to transformer coupling is achieved.

The overlay coil configuration shown uses two separate wires wound on top of each other. An equally effective arrangement utilizes bifilar wire with appropriate ground connections hand wired to insure proper amplifier driving action. In a bifilar winding arrangement the separately energized coils form a double helix about a common axis. The separate wires typically lie next to each other instead of on top of each other. Like the overlay arrangement, the bifilar arrangement insures efficient transformer coupling between the two coils.

The second speaker 111 is electrically connected by leads CL5, CL6 and crossover capacitor 122 across the two coils 14*a*, 14*b* of the first speaker 11 (see FIG. 1) and thereby advantageously utilizes the signal appearing across the first speaker's coils. Both the input signal appearing across one of the coils 14*a*, 14*b* and the transformer coupled signal appearing across the other non-energized coil appear across the voice coil 112 of the second speaker (see FIG. 2). The second speaker coil is chosen to be much less massive than the split coil 14. This reduced mass allows the second coil to respond more effectively to the high frequency signals which produce the transformer coupling in the split coil. The transformer action of the coils 14*a*, 14*b* provides a voltage across the third coil double that applied to the coil 14*a* or 14*b*. The driven coil induces an opposite polarity signal in the non-energized coil, with both signals appearing across the third coil. The second speaker is conventional in its construction and includes the typical magnet, gap, and a movable wire coil within the gap.

That coil is attached to a speaker cone which transmits the mechanical motion produced by the electro-magnetic forces exerted on the current within the voice coil to a speaker diaphragm.

The amplifier circuit 12 of FIG. 2 is housed by a receptacle 43 carried by the magnet assembly 16 associated with the first speaker 11. The circuit is a Class B push-pull circuit in which each coil 14*a*, 14*b* of the speaker split coil 14 is directly coupled to a separate emitter-follower current amplifier 45, 46. This circuit eliminates the need for an output transformer and requires no signal or stabilizing feedback circuitry.

The circuit 12 is comprised of an input transformer 48 with a primary coil 50 and a secondary coil 51 having a center tap 52. The primary coil 50 is connected to the signal output from a radio, tape player, or other amplifier (not shown). The secondary coil 51 is connected at one end 53 to the amplifier 45, and at its other end 54 to the amplifier 46. Both amplifiers 45, 46 as shown, are Darlington amplifiers, each having a base 45*a*, 46*a*, a collector 45*b*, 46*b*, and an emitter 45*c*, 46*c*. The coil end 53 is connected to the base 45*a*, and the coil end 54 is connected to the base 46*a*.

The center tap 54 of the secondary winding 51 is connected to ground or the negative terminal of a power source, such as a battery 58, through lines L1, L3 and through two diodes 55, 56, which produce a voltage drop essentially equal to the base-to-emitter drop of the two transistors that comprise each of the Darlington amplifiers 45, 46. The center tap 52 is also connected through a line L2 and a resistor R1, to a power source, such as the positive terminal of the battery 58. This circuit applies a forward bias to the bases 45*a*, 46*a*, through the secondary coil 51, so that the amplifiers 45, 46 will conduct immediately upon application of any signal voltage.

Coil lead CL1 from the outside speaker coil 14*a* is connected to the emitter 45*c* of the amplifier 45, and the coil lead CL2 from the inside speaker coil 14*b* is connected to the emitter 46*c* of the amplifier 46. A common or ground lead CL3 is connected to an end of the outside coil 14*a* opposite the end to which the lead CL1 is connected. Lead CL3 is also connected to the inside coil 14*b* by means of a connecting lead CL4. Lead CL4 is connected to the inside coil at an end opposite the end to which CL2 is attached.

Each collector 45*b*, 46*b* of the amplifiers is connected to the power source 58, i.e., to the positive terminal of the battery in the embodiment shown, through lines L4 and L5.

In operation, in the absence of an input signal at the transformer primary 50, no output signal is produced in the coils 14*a*, 14*b*. A small bias current through lines CL1 and CL2 produces fields in coils 4*a*, 14*b* in a manner to cancel each other so no displacement of the coils results. Each half of the circuit, associated with one of the amplifiers 45, 46, conducts when a positive signal is applied to the respective amplifier through the secondary winding 51 of the input transformer 48. The current flow is amplified by the Darlington amplifiers 45, 46, each of which receives power from the external source 58.

When either amplifier 45, 46 conducts, one of the speaker coils 14*a*, 14*b* is energized, driving that coil due to the operation of the permanent magnet 16. At high frequencies, rapid energization/de-energization will also produce a transformer coupling between the coils so the current is induced in the non-energized coil. When the input current to the transformer 48 varies, it will cause current to flow in one of two directions through the secondary winding 51. When current flows to the base 45*a*, the amplifier 45 conducts and directly energizes the coupled coil 14*a*. At the same time, no current flows to the base 46*a*, because when the polarity at the end 53 of the coil 51 is positive with respect to the center tap 52, the polarity at the end 54 is negative. When the input signal is reversed, causing current to be applied to the base 46*a*, the amplifier 46 directly energizes the coupled coil 14*b*.

As seen in FIG. 2, the conventional voice coil 112 in the second speaker 111 is attached by coil leads CL5, and crossover capacitor 122, CL6 across the inputs CL1, CL2 of the coils 14*a*, 14*b*. In this way both the signal appearing across the energized coil (for example 14*a*) and the induced signal on the non-energized coil (14*b*) are transmitted to the second speaker's voice coil 112. Both the induced and energization signal in the first speaker coil 14 appear across the second speaker coil 112. This provides twice the input driving voltage across the coil 112 at high frequencies and the speaker thereby more effectively reproduces high frequency signals. Since the second speaker coil is very much less massive than the overlay speaker coil, only high frequency driving signals should be applied to it. To block out the low frequency signals produced by the circuit 12, a capacitor 122 is included in series with the second speaker coil. This capacitor will block out the low frequency signals when the first speaker coil configuration is not producing a transformer coupling effect and allow high frequency signals to pass when the first coil configuration is energized at high frequencies. One embodiment of the invention utilizes a 2–3 microfarad capacitor connected in series with a conventional lightweight voice coil of an 8 ohm tweeter of 3 inch diameter. A tweeter of this construction is known within the art and can be commercially obtained from any of a number of vendors.

By way of a specific example, when the speaker system 10 is used with an automobile radio to amplify the output of the radio for greater sound, the circuit 12 is connected to the automobile battery. Typically, the so-called 12 volt battery provides 14.4 volts DC and, as shown in FIG. 2, is connected to the collector electrodes 45*b*, 46*b*. A suitable transformer 48 for the circuit 12 has a turns ratio of 1:4 (primary to secondary coils). Considering each half of the secondary winding, the transformer will provide twice the input voltage to each amplifier 45, 46. The speaker coil 14 is constructed to provide a resistance of 2 ohms for each coil 14*a*, 14*b* as compared with the 8 ohm resistance of many typical speakers. As a result, the circuit 12 provides a theoretical power amplification increase of 16 times the input signal. In actual practice, an amplification of approximately ten to twelve times the input signal is achieved.

Also by way of example, 60 volt, 8 amp. silicon Darlington transistors are used as the amplifiers 45, 46, which provide current gain of 1,000 times or greater. The resistor R, established the biasing current to the amplifiers, is a one-half watt, 1500 ohm resistor.

A 6×9 inch speaker is suitable for automotive use and a preferred speaker utilizes a ring ceramic magnet with a soft iron core and a voice coil with a diameter of 1" wound on a suitable coil form. The width of the air gap G is suitably 0.050 inch and the length of the gap and the thickness of the end plate 24 is suitably 0.25 inch. Each coil 14*a*, 14*b* extends beyond the gap G by approximately the maximum excursion of the coil and is therefore greater than 0.25 inch in length.

While a preferred embodiment of the present invention has been described in detail, it will be apparent that various modifications and alterations may be made therein without departing from the spirit and scope of the invention set forth in the claims. For example, it will be apparent that the various polarities, both electrical and magnetic, indicated in the circuit description can be reversed and the current amplifiers may be of different construction. For example, discrete transistors may be used in the place of Darlingtons, and vacuum tubes or field-effect transistors may be used in place of transistors or the like. Moreover, the benefits of the coil and speaker construction can be utilized with other than the preferred circuit.

What is claimed is:

1. In a power amplifier and two-way transducer unit comprising a first transducer, a magnet assembly defining a gap across which a magnetic flux extends to form a magnetic field, two wire voice coils of substantially identical helixes concentrically wound and secured to said first transducer and movable in said gap, means biasing said coils to a location centrally of the useful magnetic field, and an amplifier circuit directly coupled to said coils for alternately electrically energizing the moving said coils, the improvement wherein the unit includes a second transducer with a second magnetic gap and a third wire voice coil located within the second gap electrically connected to said two voice coils to move in response to energization by said circuit.

2. In a two-way speaker: a speaker cone; a permanent magnet assembly defining an annular gap across which magnetic flux extends; two substantially identical concentric helical coils forming co-axial frequency dependent inductively coupled voice coils of wire within the gap, secured to the speaker cone; means for electrically coupling an opposite end of each of the two coils to an amplifier circuit for independent electrical energization; means for grounding the nonenergized end of each of said coils to a common ground; and a second cone with a magnetic assembly and voice coil, opposite ends of the voice coil of said second cone electrically coupled to the energized ends of said helical coils.

3. The apparatus of claim 2 where the second voice coil is relatively less massive than the first voice coil.

4. The apparatus of claim 2 further including a capacitor connected in series with the second voice coil to block low frequency signals from said circuit.

5. A two-way speaker unit comprising:

(a) a first transducer including a magnetic assembly defining a gap across which a magnetic flux extends to form a magnetic field, first and second wire voice coils of substantially identical helixes concentrically wound and secured to the first transducer for movement within the gap, and biasing means urging said coils centrally of the useful extent of the magnetic field;

(b) a second transducer including a second magnetic assembly with magnetic gap and a third voice coil located within the second magnetic assembly;

(c) an amplifier circuit coupled to opposite ends of the first and second voice coils for alternately electrically energizing them to produce movement; and (d) means for electrically connecting the third voice coil to the opposite ends of the first and second voice coils to energize the third voice coil.

6. The unit of claim 5 where the unit further comprises a capacitor connected in series with the third coil to block a frequency range of electrical signals from reaching said third coil.

7. The unit of claim 6 where the third coil is less massive than the first and second coils.

8. The unit of claim 7 wherein the capacitor blocks low frequency signals in the audio frequency range.

9. A two-way speaker unit comprising:

(a) a first transducer including a magnetic assembly defining a gap and two voice coils of substantially identical co-axial construction positioned in said gap concentrically wound and electrically grounded at a common connection;

(b) an energization circuit coupled to the non-grounded ends of said two coils for alternately energizing each of said coils with a driving signal thereby causing movement of both coils within the gap;

(c) a second transducer with a third voice coil less massive than said two voice coils; and (d) means for transferring the electrical signal appearing across the two voice coils to the ends of the third voice coil in response to high frequency energization of said two coils, said electrical signal including the energization signal in one of said two coils and an induced signal in the other of said two coils.

* * * * *